US005316413A

United States Patent [19]

Sisodiya et al.

[11] Patent Number: 5,316,413

[45] Date of Patent: May 31, 1994

[54] OFFSHORE DOUBLE CONE STRUCTURE

[75] Inventors: Ram G. Sisodiya, Dublin; Dale Berner, El Cerrito, both of Calif.

[73] Assignee: Chevron Research and Technology Company, San Francisco, Calif.

[21] Appl. No.: 952,026

[22] Filed: Sep. 28, 1992

[51] Int. Cl.[5] ..... E02B 17/02

[52] U.S. Cl. ..... 405/217; 405/207; 405/211

[58] Field of Search ..... 405/195.1, 203, 204, 405/207, 211, 217

[56] References Cited

U.S. PATENT DOCUMENTS

| | | | |
|---|---|---|---|
| 4,618,286 | 10/1986 | Michel et al. | 405/217 X |
| 4,655,642 | 4/1987 | Birdy et al. | 405/217 |
| 4,778,303 | 10/1988 | Stove | 405/204 |
| 4,808,036 | 2/1989 | Bhalaik et al. | 405/217 |

OTHER PUBLICATIONS

Nordgren et al., Dynamic Ride-Up and Crushing of Short Ice Ridges on Conical Structures, 4, pp. 70-73 (1991).

Gerwick et al., Ben C. Gerwick, Inc. News, 8, pp. 1-8 (1991).

Norwegian Contractors, Arctic Drilling Structure—A Platform Designed for Northern Seas, 4, pp. 121-125 (1986).

Buslov et al., Fifty-one New Concepts for Arctic Drilling and Production, 8, pp. 46-63 (1983).

Saeki et al., The Coefficient of Friction Between Sea Ice and Various Materials Used in Offshore Structure, 8, pp. 375-382 (1984).

Greca et al., New Concept of Offshore Drilling/Production Arctic Platform and Dynamic Analysis of the Fast Removal Operation, 11, pp. 324-334 (no date).

Saeki et al., Experimental Study on Ice Forces on a Cone-shaped and an Inclined Pile Structure, 15, pp. 1081-1095 (1979).

*Primary Examiner*—David H. Corbin

*Attorney, Agent, or Firm*—S. R. La Paglia; E. A. Schaal

[57] ABSTRACT

An offshore double cone structure for operation on an ocean foundation has a double-cone concrete shell having a neck ring at the top of the shell and a base caisson that supports the double-cone shell. The caisson rests on the ocean foundation. The environmental loads, topside weight, and self weight of the double-cone shell are transferred by double-cone shell action through the base caisson to the foundation. The base caisson's exterior wall can be either vertical or sloping. The neck ring is at an elevation sufficiently high that the wave and ice interactions with the neck ring do not increase global ice loads acting on the structure. The neck ring has sufficient area to provide room for facilities through the neck.

6 Claims, 9 Drawing Sheets

OFFSHORE DOUBLE CONE STRUCTURE

OFFSHORE DOUBLE CONE STRUCTURE

The present invention relates to a double-cone structure founded on an ocean floor for offshore operations.

BACKGROUND OF THE INVENTION

Offshore structures in ice-infested waters have to resist environmental forces posed by wind, waves, currents, earthquakes, and ice. Double cone shell structures represent a very promising concept. Arctic gravity base structures require large foundation areas to resist potential ice-induced sliding and overturning. The double cone shell can be designed for adequate strength to resist concentrated ice forces without requiring the central core structure. By eliminating the core of the structure, we minimize the volume of material and cost of the structure.

SUMMARY OF THE INVENTION

The present invention provides an offshore structure that has a double-cone shell. The two cones are connected to a base caisson that provides a large base area for a foundation on the ocean floor. A neck ring connects the two cones at the top. The double-cone transfers its self-weight, environmental loads, and topside weight, by double-cone shell action through the double-cone to the base caisson. The base caisson transfers these loads and its self-weight to the foundation. The surface of the cones can be either curved or multi-faceted. The base caisson's exterior wall can be either vertical or sloping. Preferably, the neck ring of the double-cone shell is at an elevation sufficiently high that the wave and ice interaction with the neck ring do not increase global ice loads acting on the structure.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

In its broadest aspect, the present invention involves a double cone structure for offshore operations. That structure has a double-cone shell having a neck ring at the top of the shell, and a base caisson supporting the double-cone shell. The caisson rests on the ocean floor foundation.

By "offshore double cone structure," we mean an offshore structure having concentric cones to resist ocean wave and sea ice loads. The structure provides a platform for supporting offshore facilities. The two cones connected by bulkheads provide a stiff shell to resist ice loads or ocean wave loads. The double-cones can be of different sizes and cone angles, depending upon water depth and design loads. The cones could be made out of reinforced or prestressed concrete, or a composite of steel/concrete/steel sandwich sections. The surfaces of the cones can be either curved or multi-faceted.

Figure 4:
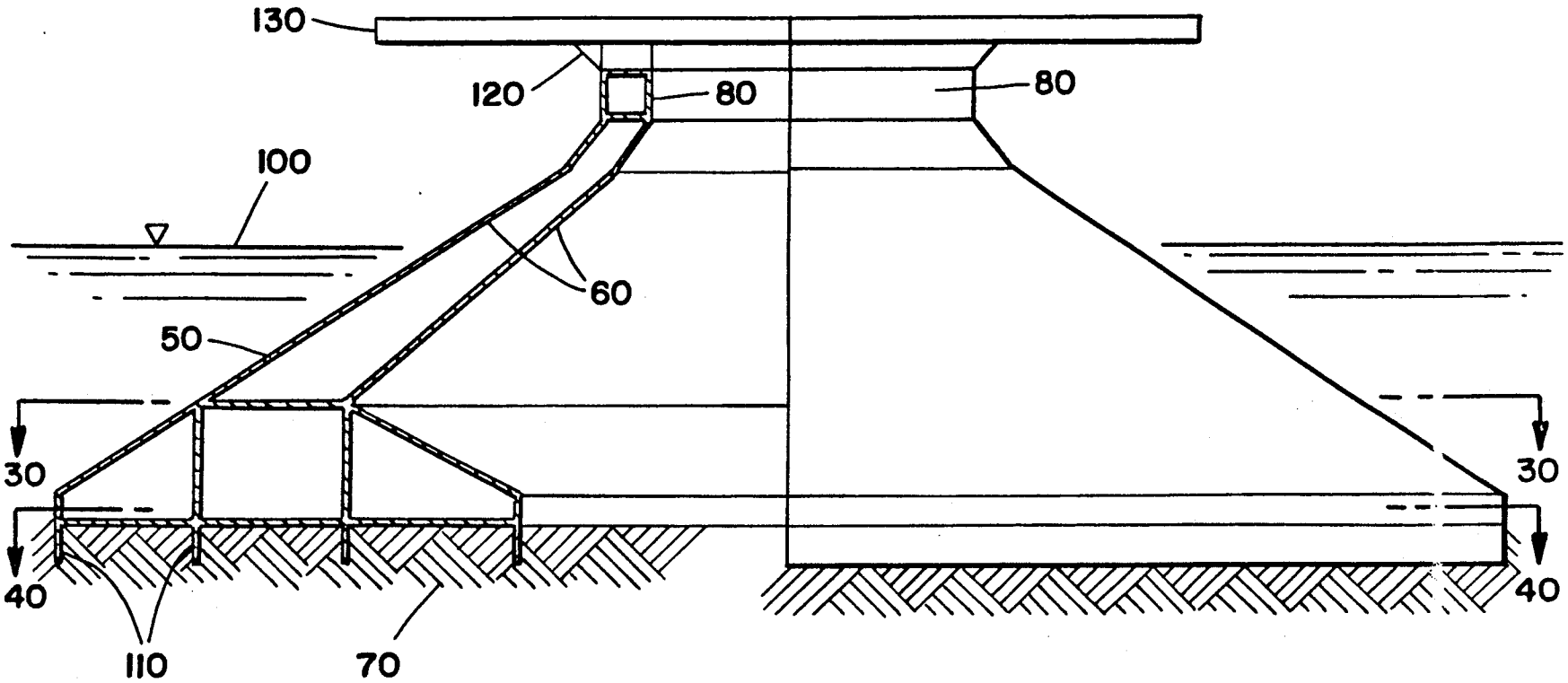
FIG. 4 shows a design of a circular double cone structure for 110 feet water depth including a vertical section through the center.

By "base caisson," we mean the part of the structure directly below and supporting the two cones to transmit loads to foundation. In some designs, the exterior wall of the base caisson is vertical. In other designs, the outer cone could extend into the base caisson to provide an exterior sloping face in the caisson, as shown in FIG. 4. A base caisson having a vertical exterior wall could be used for sufficiently deep water location, where ice would not hit the wall. That type of base caisson could also be used if the base area is sufficient to found the structure on sea bottom. A base caisson exterior having a sloping wall could be used to decrease ice loads in cases where ice could hit the wall, or to provide larger base area to found the structure on sea bottom.

The base caisson provides a large base are to transfer the loads from the double cones to the foundation. It also provides sufficient bouyancy and cross-section area at water level such that the structure has acceptable hydrostatic stability and draft during towout. The base caissons can have radial and circumferential bulkheads, honeycomb cells, or other precast cells for internal structural arrangements. The base caisson could be constructed using reinforced/prestressed concrete, or composite steel/concrete/steel sandwich sections, or steel alone.

Figure 1:
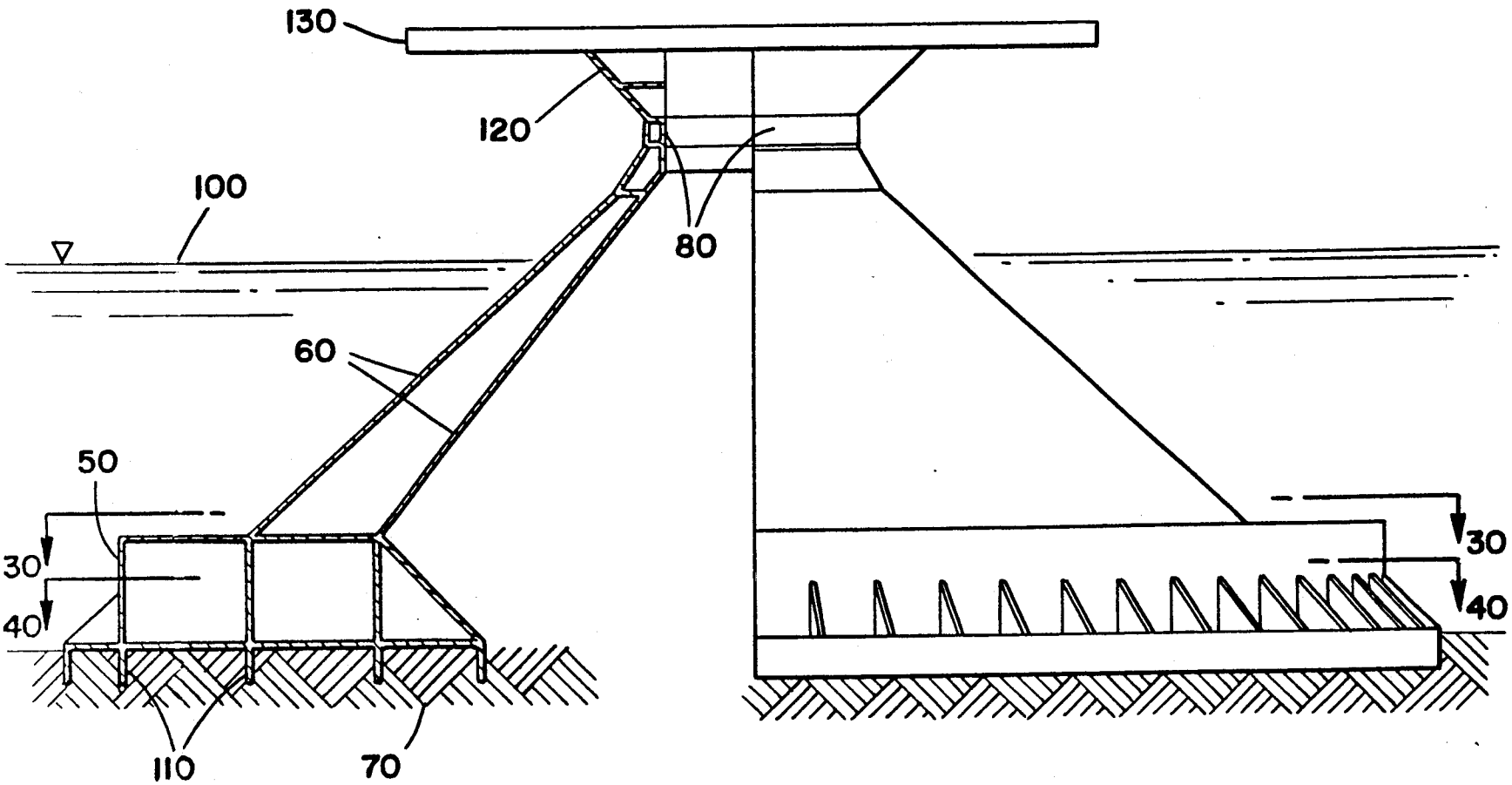
FIG. 1 shows one design of a circular double cone structure for 200 feet water depth including a vertical section through the center.

The exterior wall of the base caisson can be an extension of the exterior cone, as shown in FIG. 4, or a separate cone or a cylinder, as shown in FIG. 1.

The stiff double-cone shell transfers environmental loads, topside weight, and its own weight by double-cone shell action through the shell to the base caisson. The base caisson transfers these loads and its own weight to the foundation. By "environmental loads," we mean loads due to ocean waves and currents, moving sea ice, and wind loads. The sea ice could include first year ice, multi-year, or glacier ice. By "topsides weight" we mean the gravity weight of the deck and all the facilities on top of the deck. By "self-weight" we mean the submerged gravity weight of the complete structure.

Preferably, the top of the exterior cone is at an elevation such that the ocean waves and the sea ice interactions with the neck ring do not increase global load on the structure.

The double cones, connected by bulkheads, act jointly like a stiff shell. The base caisson supports the double cone and transfers the loads from the double-cone shell to the foundation. Concrete or steel skirts could be used below the base caisson to increase the foundation capacity for sliding resistance.

By "neck ring at the top of the shell," we mean the part of the structure directly above the two cones. The neck ring acts like a ring beam to provide additional stiffness to the cones. The surface of the neck ring can be either curved or multi-faceted. Preferably, the neck ring has sufficient size for its intended use. For example, if the structure is to be used for drilling or oil production ,the size should be sufficient to house a design number of well slots and to enable drilling.

Above the neck ring is an inverted cone used to provide support for the topside deck. Steel is preferred for the inverted cone to minimize the weight.

FLOATING STABILITY

The buoyancy and floating stability of the whole structure during tow out to the installation location is achieved in the design by providing sufficient buoyancy in the base caisson. In some design cases, additional temporary buoyancy may be required for stability during installation or during mating of the top deck.

CONSTRUCTION SEQUENCE

These are several possible construction options. These are listed as follows:

The structure could be constructed using reinforced/prestressed concrete or using composite steel/concrete/steel sections. The composite sections can be constructed by fabricating water-tight steel chamber with appropriately stiffeners and shear keys. The chambers, after being filled with concrete, are connected to form the structure. The reinforced/precast concrete can be cast in-place concrete, or made from precast concrete sections. Some parts of the structure, like the inverted cone about the top ring, some bulkheads, or skirts could be made of steel alone to reduce the weight of the structure.

Figure 3:
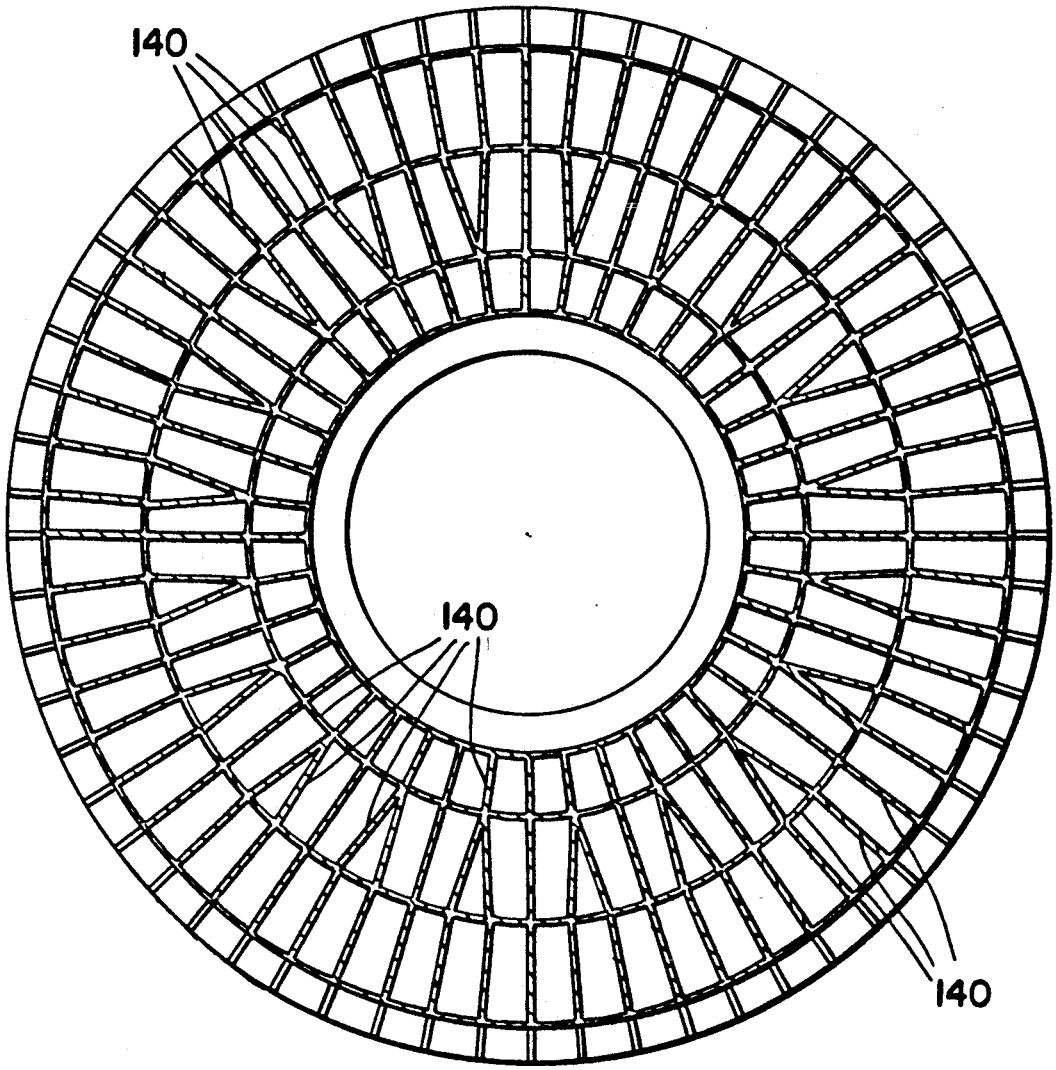
FIG. 3 shows a horizontal section through the bottom caisson of a circular double cone structure for the 200 feet water depth design.
Figure 5:
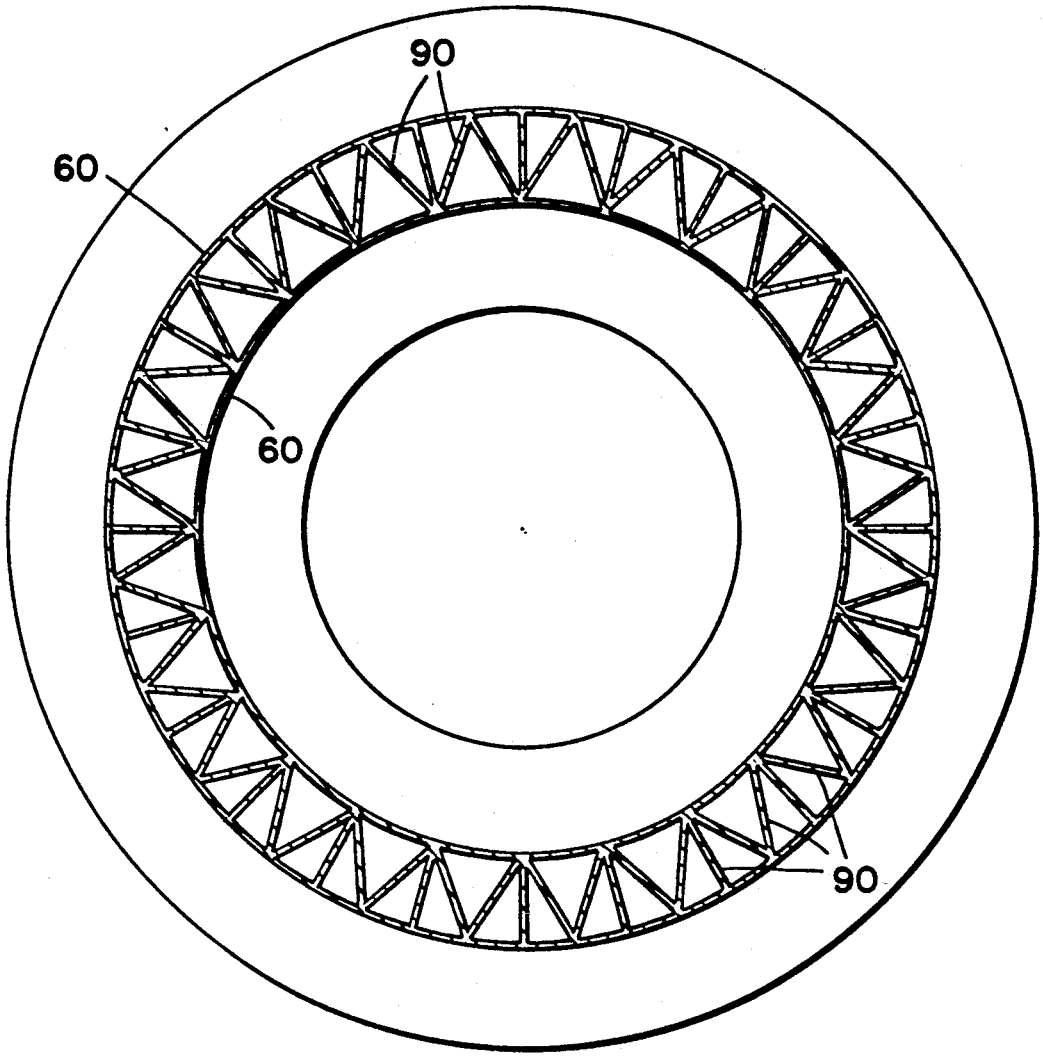
FIG. 5 shows a horizontal section through the circular double cones above bottom caisson for the 110 feet water depth design.

The bottom caisson could be designed with bulkhead arrangements, as shown in FIGS. 3 and 5, or using honeycomb or grid cells.

The base caisson can be constructed in small plan sections in a drydock and connected together afloat, or by constructing the base caisson as a complete unit in plan in drydock. In dry dock, the caisson could be constructed either to its full height or to a partial height to meet draft requirements. Fabrication of base caisson includes construction of skirts.

The double cones are erected on top of the base caisson either by casting in place or by using pre-cast sections, again using reinforced/prestressed concrete or using composite steel/concrete/steel sections. If the composite section is used the inner steel cone would serve as the supporting form for concrete.

Figure 2:
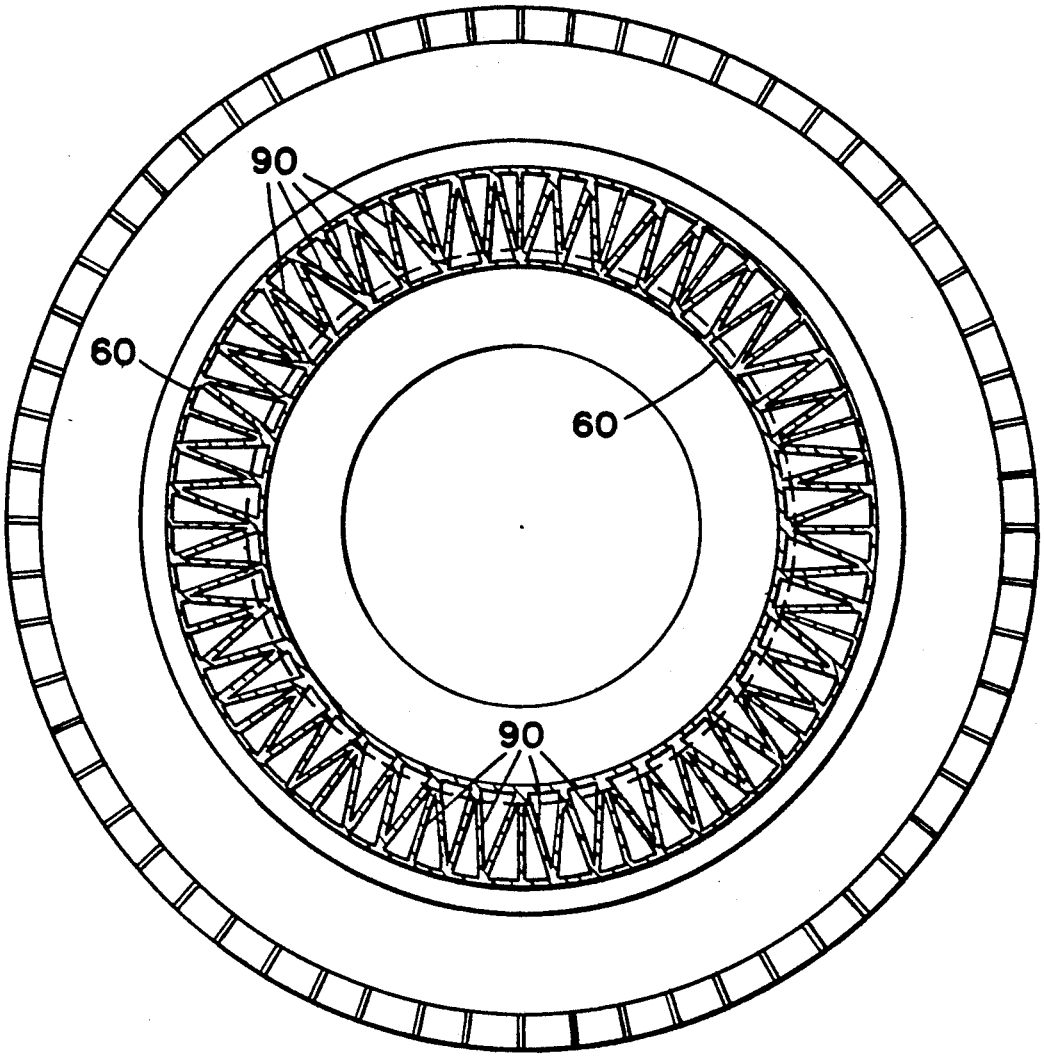
FIG. 2 shows a horizontal section through the circular double cones above the bottom caisson for the 200 feet water depth design.

Referring to FIG. 1, the left side of the figure is a vertical cross-section of a design of a circular double cone structure for 200-foot water depth. The right side of the figure is an elevation view of platform. Level 30 is a level for horizontal cross-section through the double cones, as shown in FIG. 2. Level 40 is a level for horizontal cross-section through the bottom caisson, as shown in FIG. 3. Level 100 is mean sea level.

Base caisson 50, with a circular cross-section and skirts 110, rests on ocean foundation 70 and supports double cones 60. Double cones 60 and neck ring 80 form a double-cone shell. Inverted cone 120, with circular cross-section, rests on top of the double-cone shell. Top deck 130 rests on top of the inverted cone.

FIG. 2 shows a horizontal section through the circular double cones above the bottom caisson for the 200-foot water depth design at level 30. Double cones 60 are connected by bulkheads 90.

FIG. 3 shows a horizontal section through the bottom caisson of a circular double cone structure for the 200-foot water depth design. Note radial and circumferential bulkheads 140 inside the base caisson 50.

Figure 6:
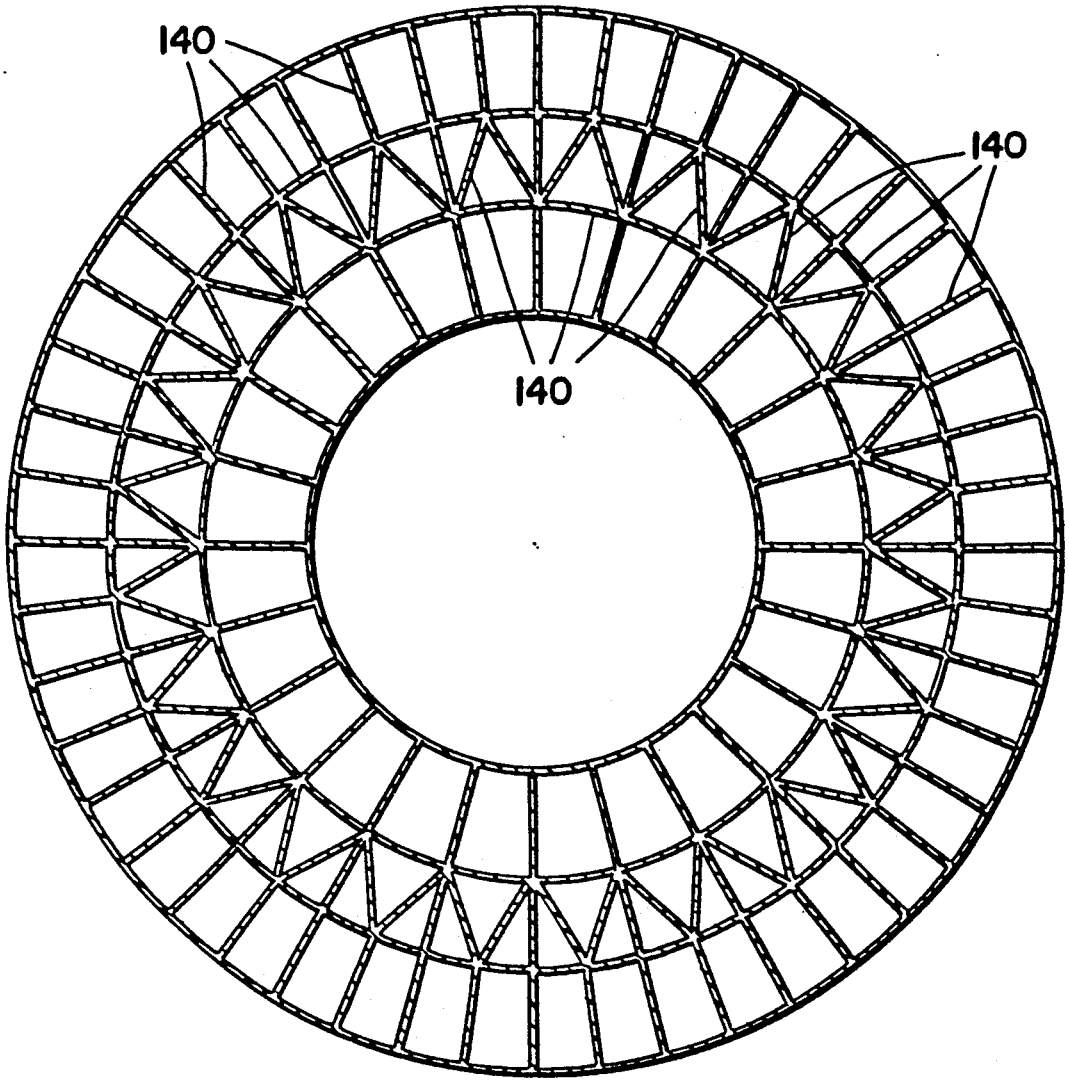
FIG. 6 shows a horizontal section through the bottom caisson of a circular double cone structure for the 110 feet water depth design.

FIGS. 4, 5, 6 show a circular double cone structure for the 110-foot water depth design, having a sloping base caisson 50.

Figure 7:
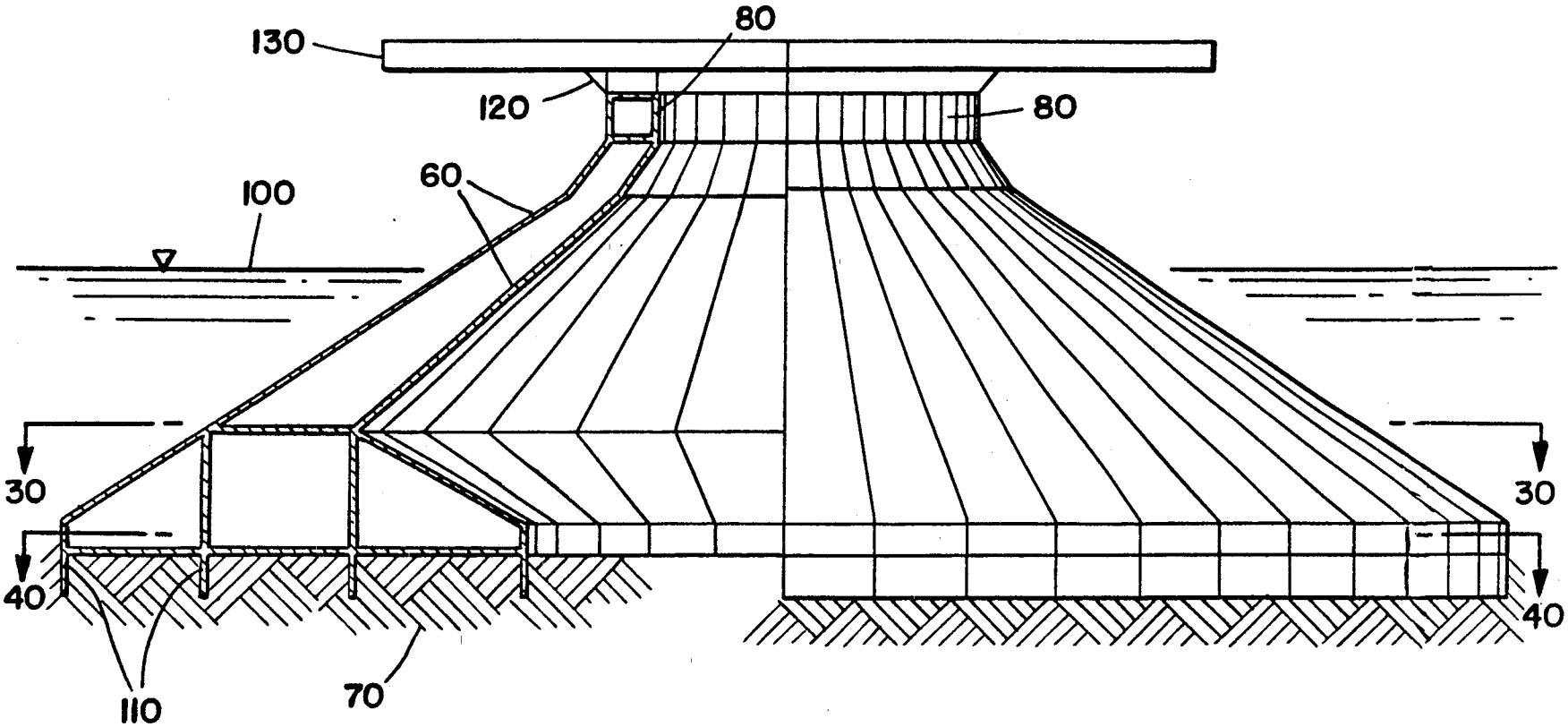
FIG. 7 shows a multi-faceted double cone structure for 110 feet water depth including a vertical section through the center.
Figure 8:
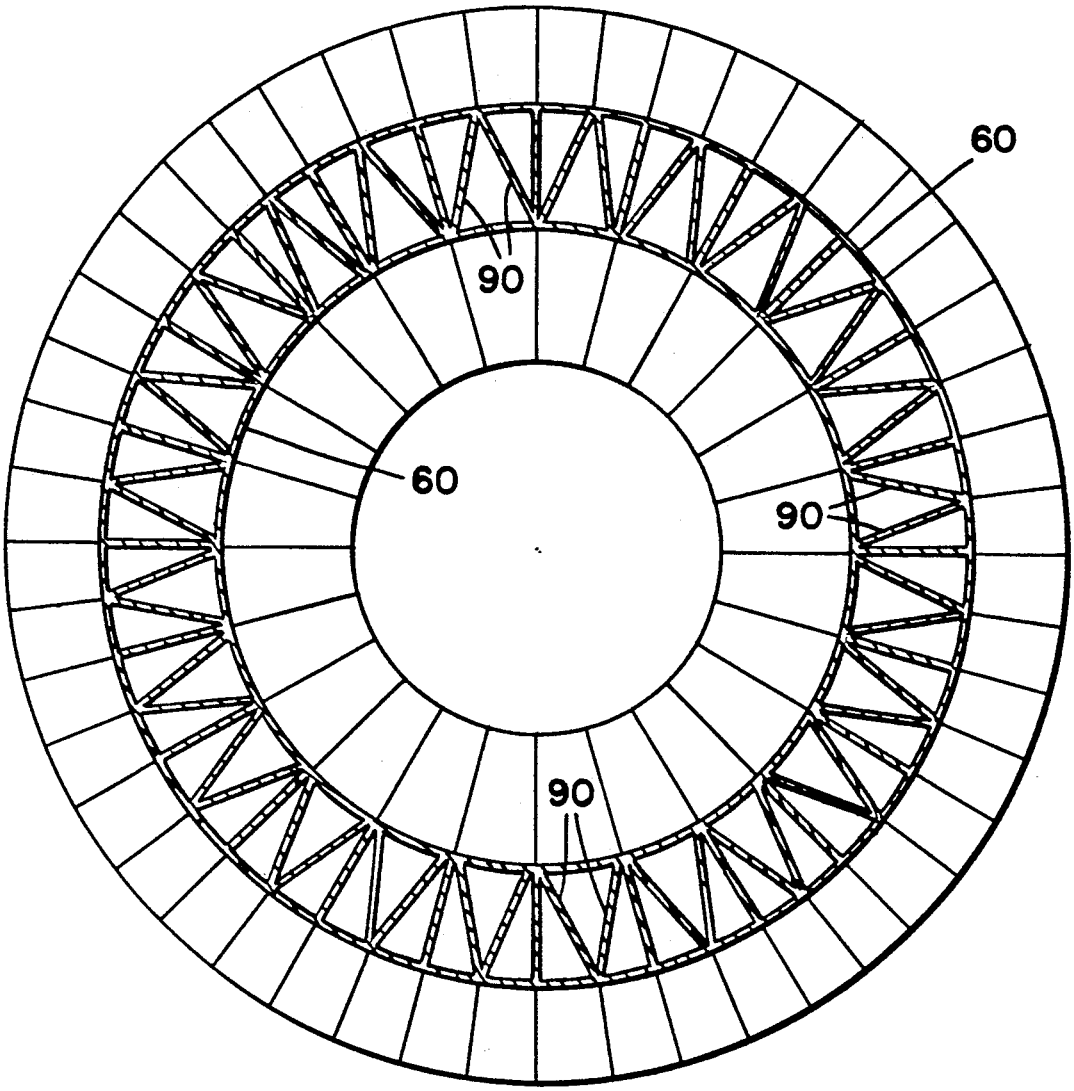
FIG. 8 shows a horizontal section through the multi-faceted double cones above bottom caisson for the multi-faceted double cone structure.
Figure 9:
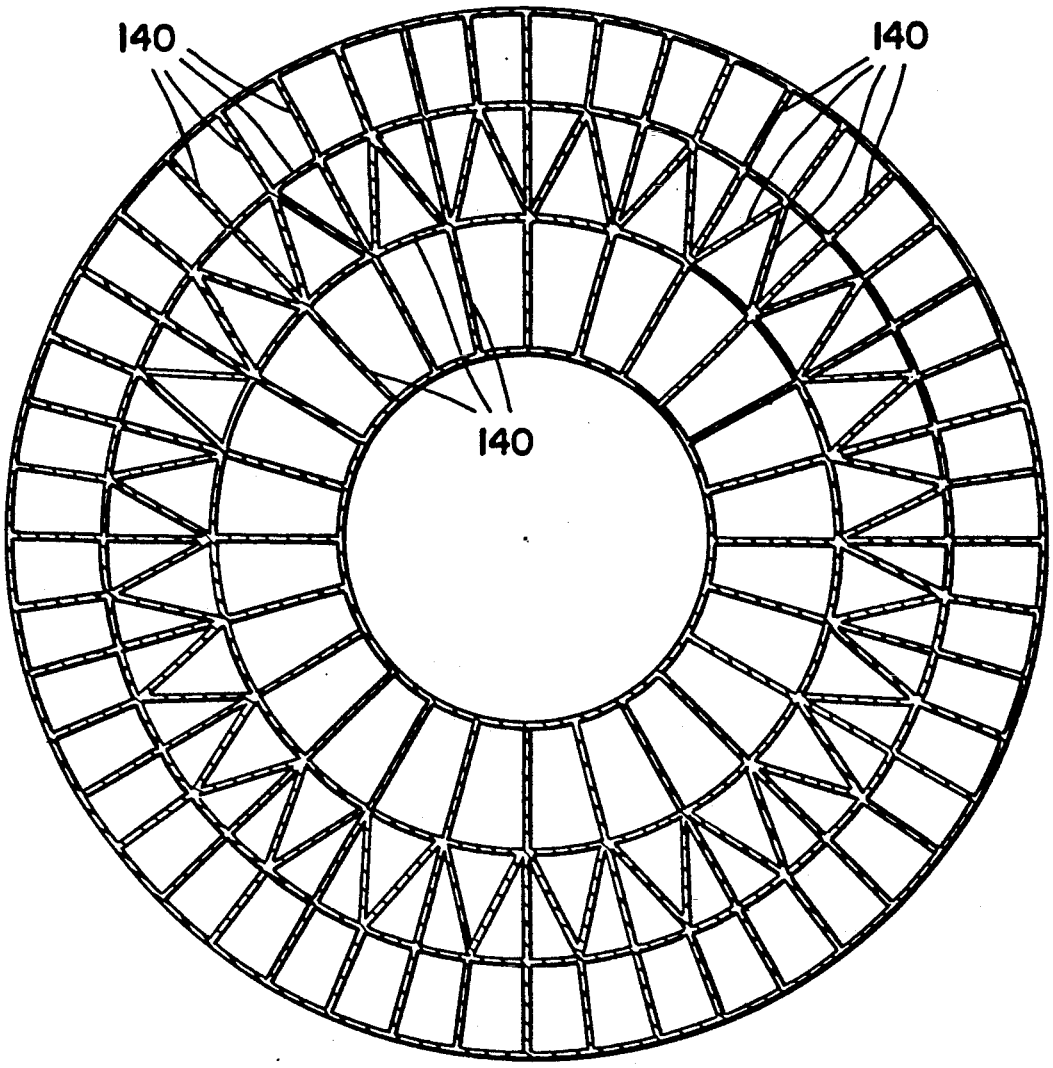
FIG. 9 shows a horizontal section through the bottom caisson for the multi-faceted double cone structure.

FIGS. 7, 8, 9 show a multi-faceted double cone structure. In this embodiment, the double cones 60, the neck ring 80, and inverted cone 120 are all multi-faceted.

While the present invention has been described with reference to specific embodiments, this application is intended to cover those various changes and substitutions that may be made by those skilled in the art without departing from the spirit and scope of the appended claims.

What is claimed is:

1. An offshore bottom founded structure for operation on an ocean floor foundation comprising:

(a) a outer conical shell;

(b) an inner conical shell positioned concentric with said outer shell;

(c) a load resistance system positioned on the periphery of the structure, said system comprising an internal bracing interposed between and rigidly coupling said outer and inner shells to form a double-cone shell, said double cone having a neck ring fixedly positioned above said double-cone to increase the rigidity of said double-cone; and (d) a base-caisson supporting the double cone shell, said caisson positioned to rest on the ocean foundation and transfer, by a double-cone shell action, environmental loads, topside weight, and self weight of the double-cone shell through the base caisson to the foundation.

2. An offshore structure according to claim 1 wherein the inner and outer cones are circular in cross-section.

3. An offshore structure according to claim 1 wherein the inner and outer cones are multi-faceted.

4. An offshore structure according to claim 1 wherein the base caisson's exterior wall is vertical.

5. An offshore structure according to claim 1 wherein the base caisson's exterior wall is sloping.

6. An offshore structure according to claim 1 wherein the neck ring is at an elevation sufficiently high that the ice interaction with the neck ring does not increase global ice loads acting on the structure.

* * * * *